US008771428B1

(12) United States Patent
Goentzel

(10) Patent No.: US 8,771,428 B1
(45) Date of Patent: Jul. 8, 2014

(54) CLEANING BUCKET SYSTEM FOR FLAT MOPS

(71) Applicant: Howard Goentzel, Palmer, AK (US)

(72) Inventor: Howard Goentzel, Palmer, AK (US)

( * ) Notice: Subject to any disclaimer, the term of this patent is extended or adjusted under 35 U.S.C. 154(b) by 0 days.

(21) Appl. No.: 14/026,926

(22) Filed: Sep. 13, 2013

Related U.S. Application Data

(62) Division of application No. 13/373,951, filed on Dec. 5, 2011, now Pat. No. 8,652,263.

(51) Int. Cl.
*B08B 7/00* (2006.01)

(52) U.S. Cl.
USPC ..... 134/6; 15/257.1; 15/260; 15/261; 15/262; 15/263; 15/264; 206/515; 206/518; 206/519; 206/520; 220/23.2; 220/23.4; 220/507; 220/553; 220/555

(58) Field of Classification Search
CPC ..... A47L 13/08; A47L 13/11; A47L 13/20; A47L 13/50; A47L 13/58; A47L 13/59
USPC ..... 134/6; 15/257.1, 260–264; 206/515, 206/518, 519, 520; 220/23.2, 23.4, 507, 220/553, 555
See application file for complete search history.

(56) References Cited

U.S. PATENT DOCUMENTS

| | | | | |
|---|---|---|---|---|
| 4,161,799 | A * | 7/1979 | Sorrells | 15/260 |
| 6,006,397 | A * | 12/1999 | Williams et al. | 15/261 |
| 6,996,873 | B2 * | 2/2006 | Salmon | 15/261 |
| 7,174,600 | B2 * | 2/2007 | Kresse et al. | 15/260 |
| 8,082,620 | B2 * | 12/2011 | Hoyle et al. | 15/261 |
| 8,474,089 | B2 * | 7/2013 | Goentzel | 15/260 |
| 2004/0143926 | A1 * | 7/2004 | Ramirez | 15/262 |
| 2013/0312211 | A1 * | 11/2013 | Matola | 15/262 |

* cited by examiner

*Primary Examiner* — Bibi Carrillo
(74) *Attorney, Agent, or Firm* — Michael J. Tavella

(57) ABSTRACT

A double bucket cleaning system for use with microfiber mat mops. One bucket contains clean water; the second holds dirty water. The second bucket has a slide press for extracting dirty water from the mop. The system can use a connector to connect the two buckets together, or a single bucket with two compartments can be used. Both designs use a footpad upon which the user stands during the pressing operation. This ensures that the device remains in place during the sliding. Finally, once the dirty water has been extracted from the mop, the user can pick up clean water from the first bucket for the next portion of the floor to be cleaned. In this way, the user is able to quickly clean a large floor with clean water, instead of repeatedly dipping the mop back into dirty water.

6 Claims, 14 Drawing Sheets

CLEANING BUCKET SYSTEM FOR FLAT MOPS

CROSS REFERENCE TO RELATED APPLICATIONS

This application is a Divisional of Ser. No. 13/373,951, filed Dec. 5, 2011, now U.S. Pat. No. 8,652,263.

STATEMENT REGARDING FEDERALLY SPONSORED RESEARCH AND DEVELOPMENT

Not Applicable

BACKGROUND OF THE INVENTION

1. Field of the Invention

This invention relates to bucket systems for mops and particularly to bucket systems for flat mops.

2. Description of the Prior Art

Mops have been used for centuries. Currently, commercial cleaners often prefer flat mops, such as the microfiber flat mops by 3M corporation. These mops have a flat pad that absorbs and holds water very similar to the old string type mops. However, the flat design allows the user to cover more floor space. The flat pad also has other advantages over the old style of mops. Currently, these mops are cleaned by pressing them against a plate in a specially designed bucket that fits the mops. The user dips the mop into the lower portion of the bucket to wet the mop. After mopping a section of floor, the user then presses the mop against a plate to press out the water. There are several problems with this design. First, there is little stability in the bucket. Pressing too hard on the plate can cause the bucket to tip backwards. Also, there is no way to restrain the bucket when it is being used. The wheels are not easily secured. As a result, there is a high probability that the pad will not be thoroughly pressed out before the next use. Finally, and perhaps the biggest problem is that the user must press out the dirty water from the mop back into the same bucket the user is using for cleaning. Thus, after only a short while the user is left with a bucket full of dirty water. This requires frequent empting and refilling of the bucket to keep the floor clean.

BRIEF DESCRIPTION OF THE INVENTION

The instant invention overcomes all these problems. It is a double bucket cleaning system for use with microfiber mat mops. One bucket contains clean water; the second holds dirty water. The second bucket has a slide press for extracting dirty water from the mop. The system can use a connector to connect the two buckets together, or a single bucket with two compartments can be used. Both designs use a footpad upon which the user stands during the pressing operation. This ensures that the device remains in place during the sliding. The slide press has a pair of flexible plastic extractors that scrape the bottom of the mop pad to clean it. Once the dirty water has been extracted from the mop, the user can pick up clean water from the first bucket for the next portion of the floor to be cleaned. In this way, the user is able to quickly clean a large floor with clean water, instead of repeatedly dipping the mop back into dirty water.

DETAILED DESCRIPTION OF THE INVENTION

Figure 1:
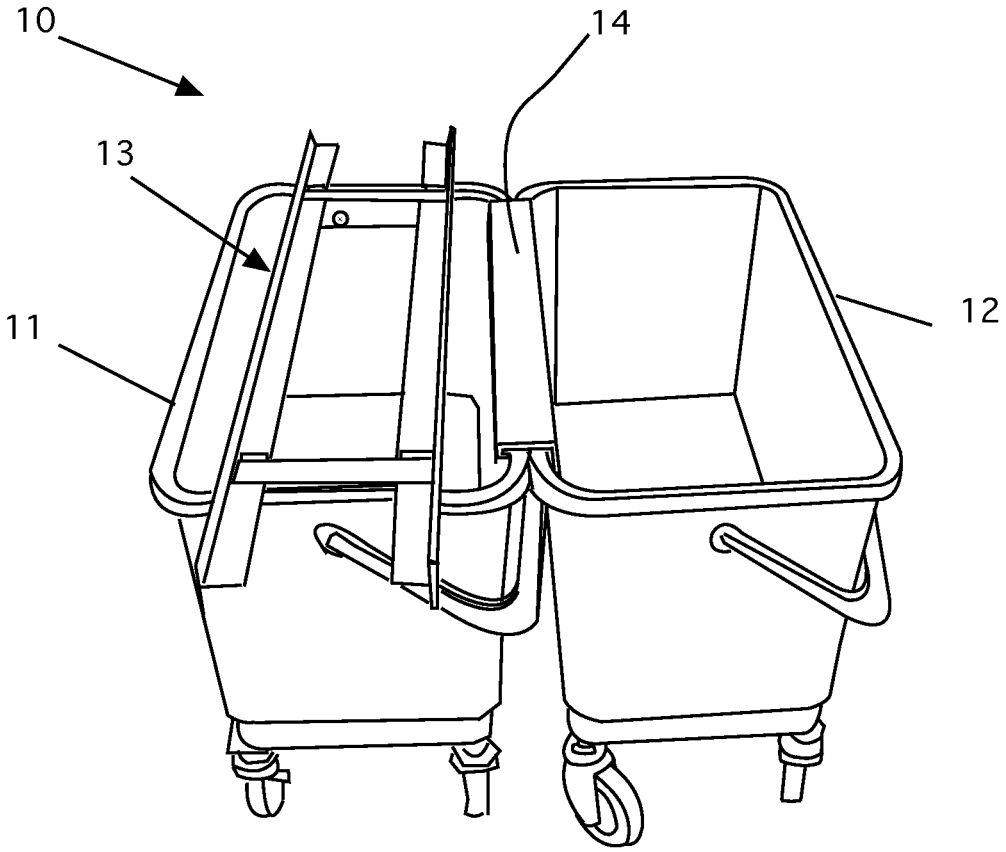
FIG. 1 is a side perspective view of the assembled invention with no water in the buckets.

FIG. 1 is a side perspective view of the assembled invention with no water in the buckets. Here, the invention 10 has two buckets 11 and 12. Bucket 11 is shown with the slide press 13 installed. Bucket 11 is used for holding the dirty water. Bucket 12 is used for clean water. Unlike my previous design, which used a frame to hold the buckets, this design is simplified by using a connector 14 to secure the two buckets together. The connector 14 is a U-shaped channel that snaps onto the edges of the buckets as shown. Once attached, the buckets can be moved together as desired.

Figure 2:
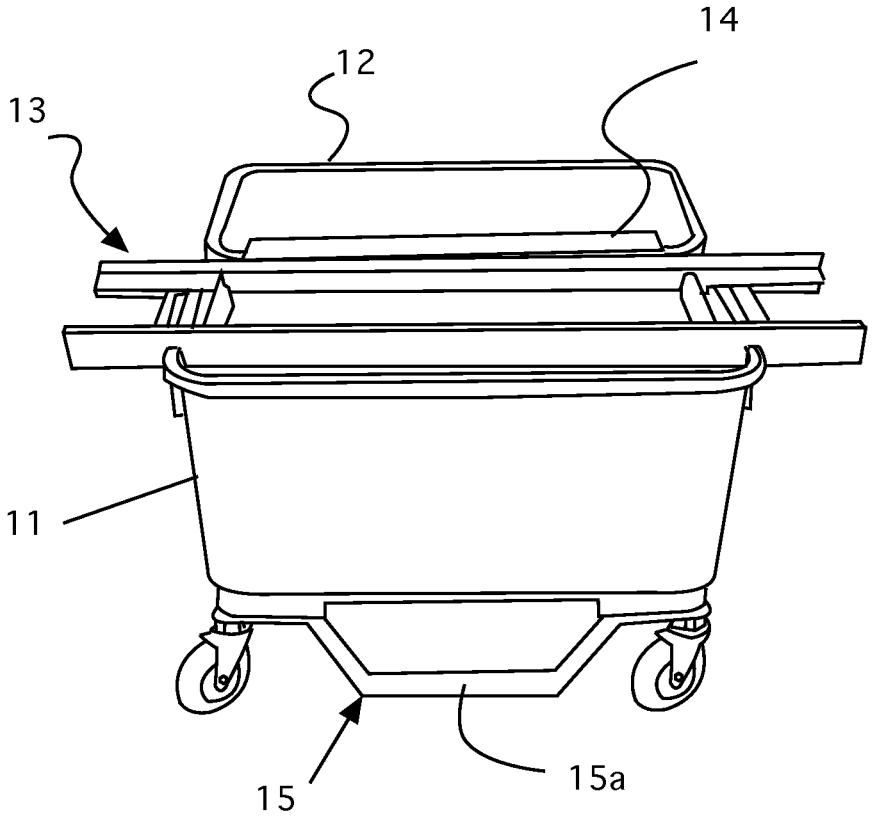
FIG. 2 is a front perspective view of the invention.

FIG. 2 is a front perspective view of the invention. In this view the buckets 11 and 12 the slide press 13 and the connector are shown. At the bottom of the cleaning bucket 11*a* step 15 is provided. The step 15 is a formed piece of metal or plastic that has a center portion 15*a* that extends down to the floor surface. A user stands on this center portion when using the slide press to hold the buckets in place during the pressing operation.

Figure 3:
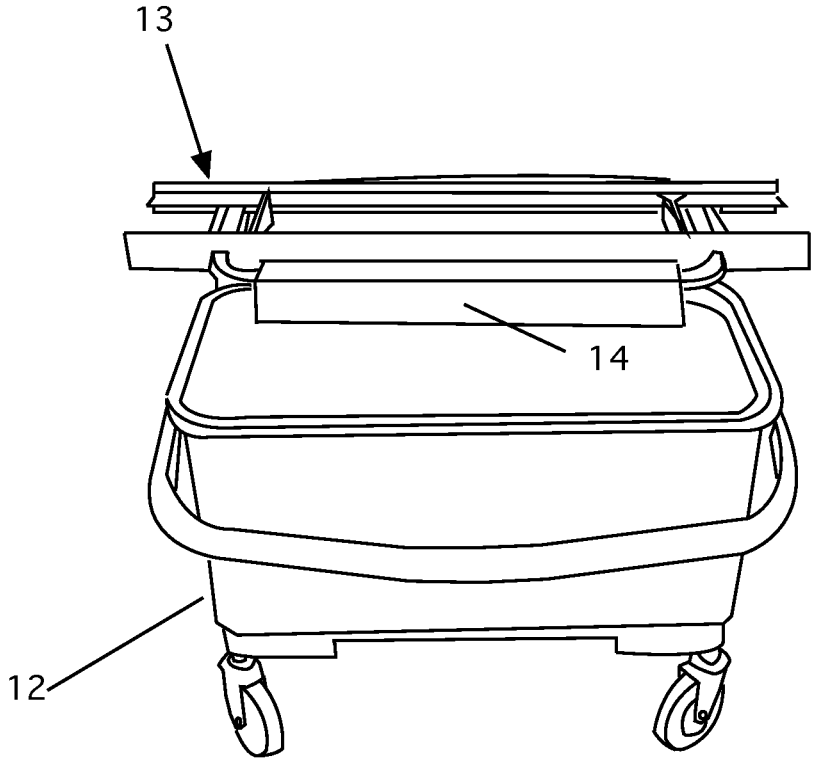
FIG. 3 is a rear perspective view of the invention.

FIG. 3 is a rear perspective view of the invention. As before, in this view the buckets 11 and 12 the slide press 13 and the connector are all shown. However, there is no step on bucket 12, as it is not needed.

Figure 4:
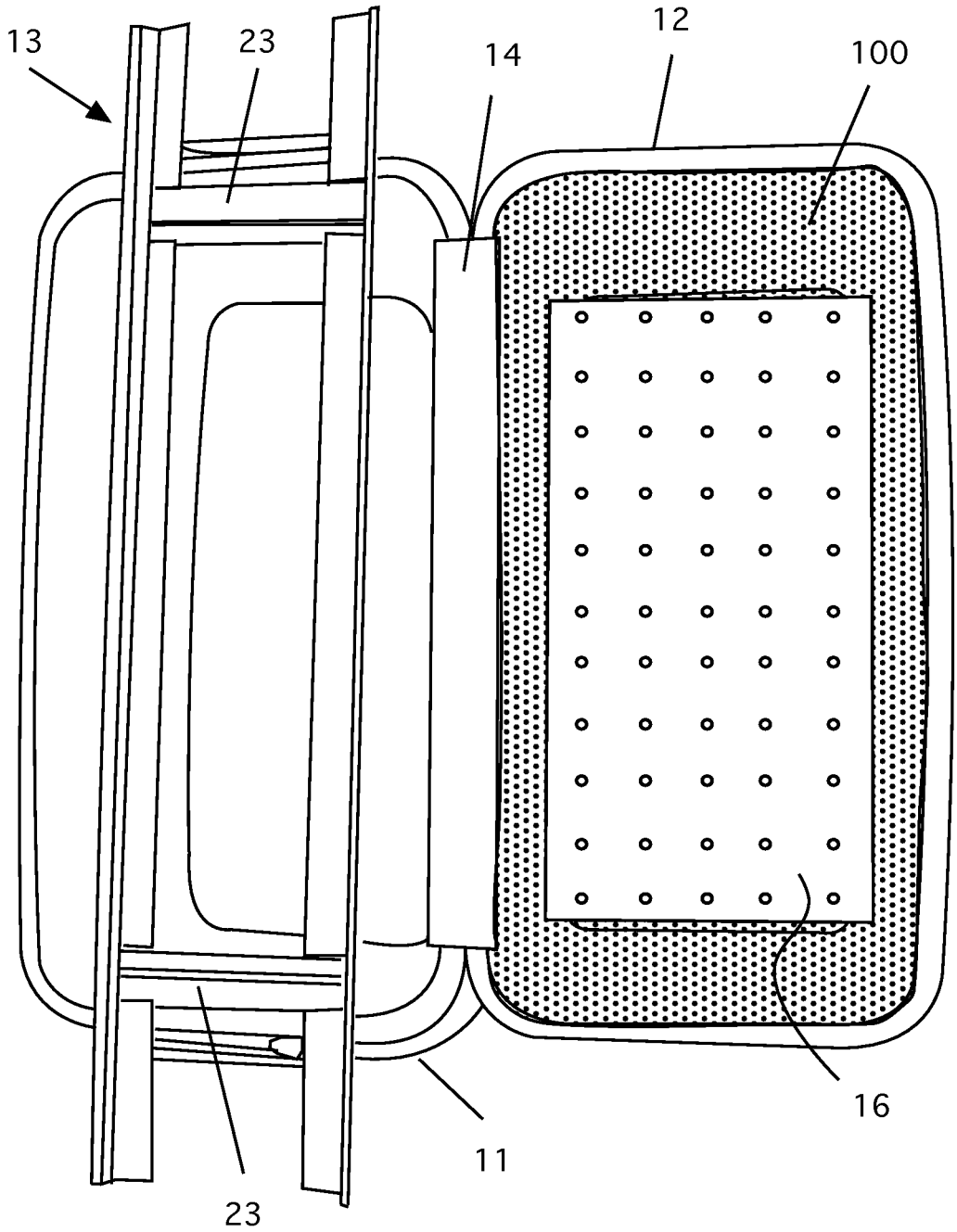
FIG. 4 is a top view of the invention showing water in the clean bucket.

FIG. 4 is a top view of the invention showing water in the clean bucket. In this view, the clean bucket 12 is shown full of water 100. It has a float 16 in it that floats on top of the water and is used to reduce splashing from the bucket. The slide press is shown installed on the bucket 11 and the connector 14 is also shown.

Figure 5:
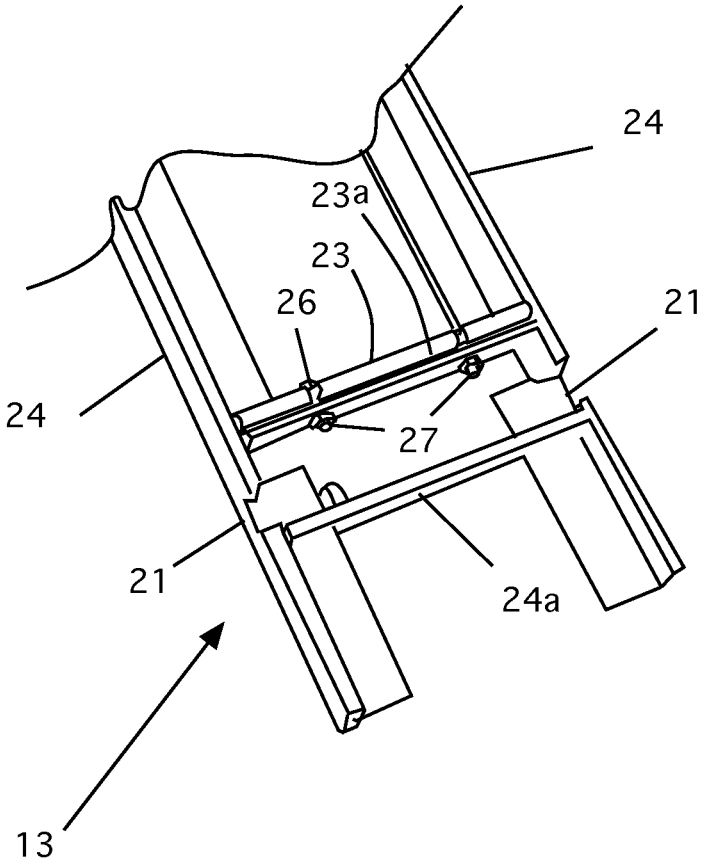
FIG. 5 is a detail view of a portion of the slide press.
Figure 6:
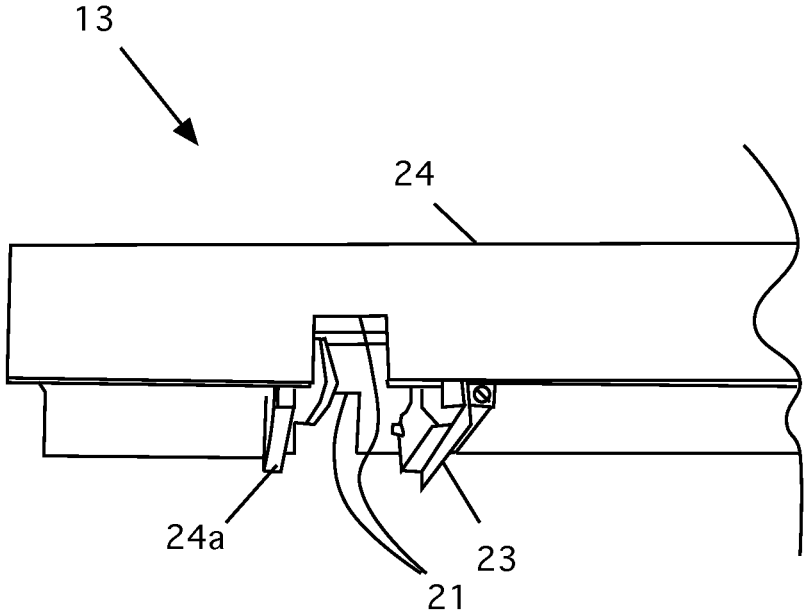
FIG. 6 is a front detail view of the end of the slide press.

FIG. 5 is a detail view of a portion of the slide press. FIG. 6 is a front detail view of the end of the slide press. The key to this device is the slide press 13. As in the case of my earlier design, this slide is designed to fit atop the bucket. The slide press has a frame 24 that has lower flanges 21 that engage the sidewalls of the bucket to hold it in place as shown is FIG. 6. The frame is supported by cross flanges 24*a*. The slide press 13 has a pair of extractors 23 attached. FIG. 6 is a detail view of the extractors 23 on the slide press. The extractors 23 have a flexible plastic blade 23*a* that scrapes the mop pad as it is being moved through the slider. Although similar to squeegees, the extractors are actually a hard plastic material unlike the softer, more flexible rubber of squeegees. The height of the extractors can be controlled by bolts 26 and nuts 27 that are attached to the extractors as shown. As the mop is slid across the extractors, the user applies pressure to ensure proper cleaning of the mop. Note that FIG. 6 shows a portion of the flexible blade 23*a* extending down from the extractor 23.

Figure 7:
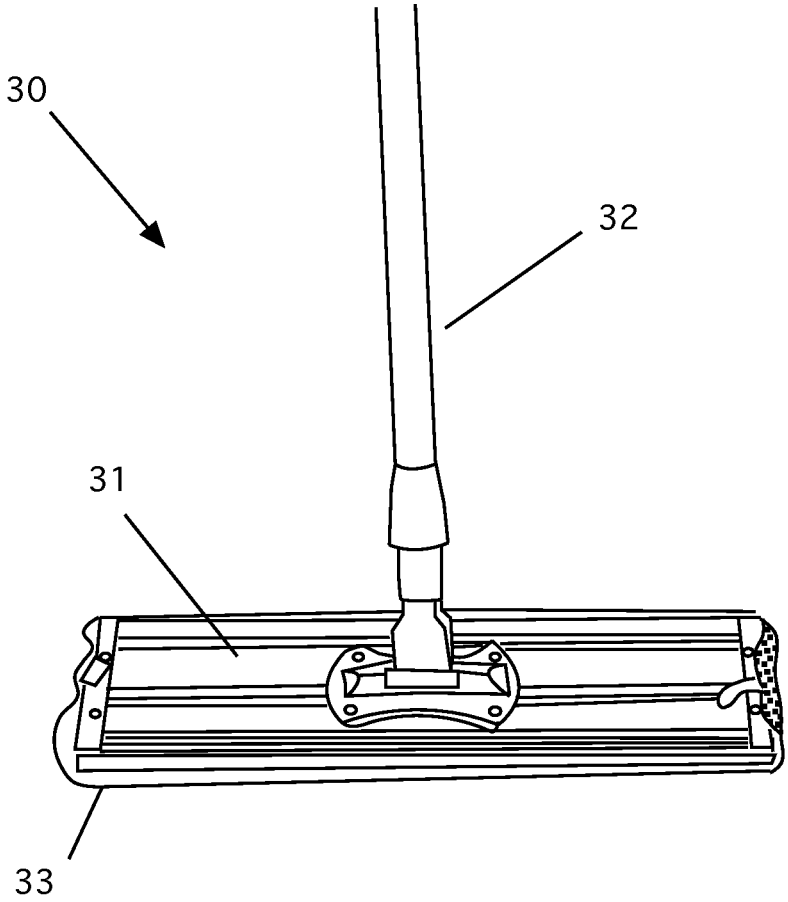
FIG. 7 is a front view of a mop used with the invention.

FIG. 7 is a front view of a mop used with the invention. In the preferred embodiment, the mop 30 is a common mop that has a rectangular base 31*a* handle 32 and a microfiber cleaning pad 33. These mops are generally available and are a microfiber flat mop sold by the 3M corporation of Minneapolis, Minn.

Figure 8:
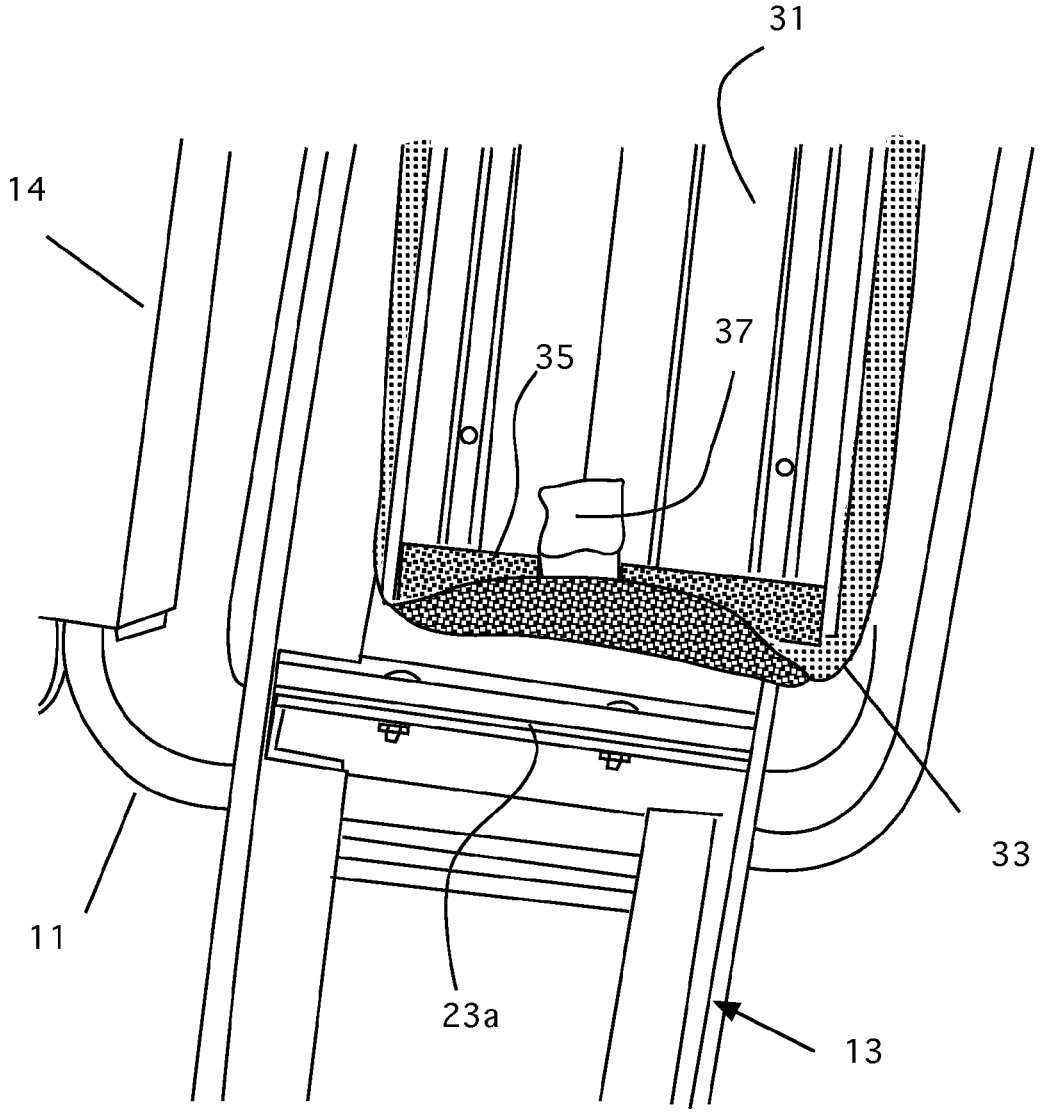
FIG. 8 is a top detail view of the mop being aligned with the slide press for use and showing the microfiber pad secured to the mop plate with a hook and loop type fastener.

FIG. 8 is a top detail view of the mop being aligned with the slide press 13 for use and showing the microfiber pad 33 secured to the mop plate 31 with a strip of hook type fastener 34, that is attached to the pad and a strip of loop fastener 35 that is secured to the mop base 31. This view is also a detail of the end of the mop as it is being positioned in the slide press 13.

Figure 9:
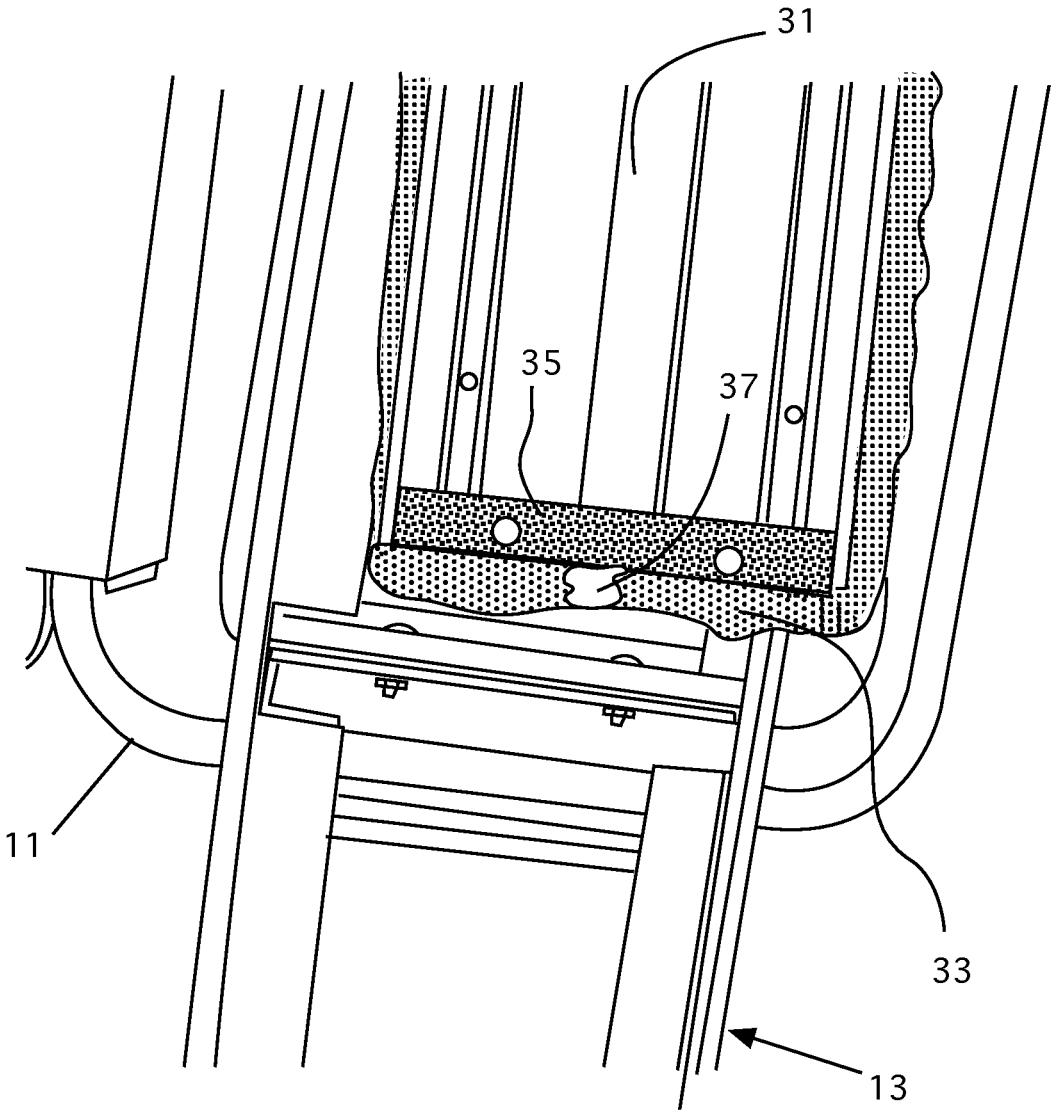
FIG. 9 is a top detail view of the mop being aligned with the slide press for use and showing the microfiber pad unsecured from the mop plate.

FIG. 9 is a top detail view of the mop being aligned with the slide press for use and showing the microfiber pad unsecured from the mop plate. In this figure, the pad 33 is shown separated from the mop base 31. This is done by lifting tab 37 from the strip 35. In this way, the pads can be easily replaced.

Figure 10:
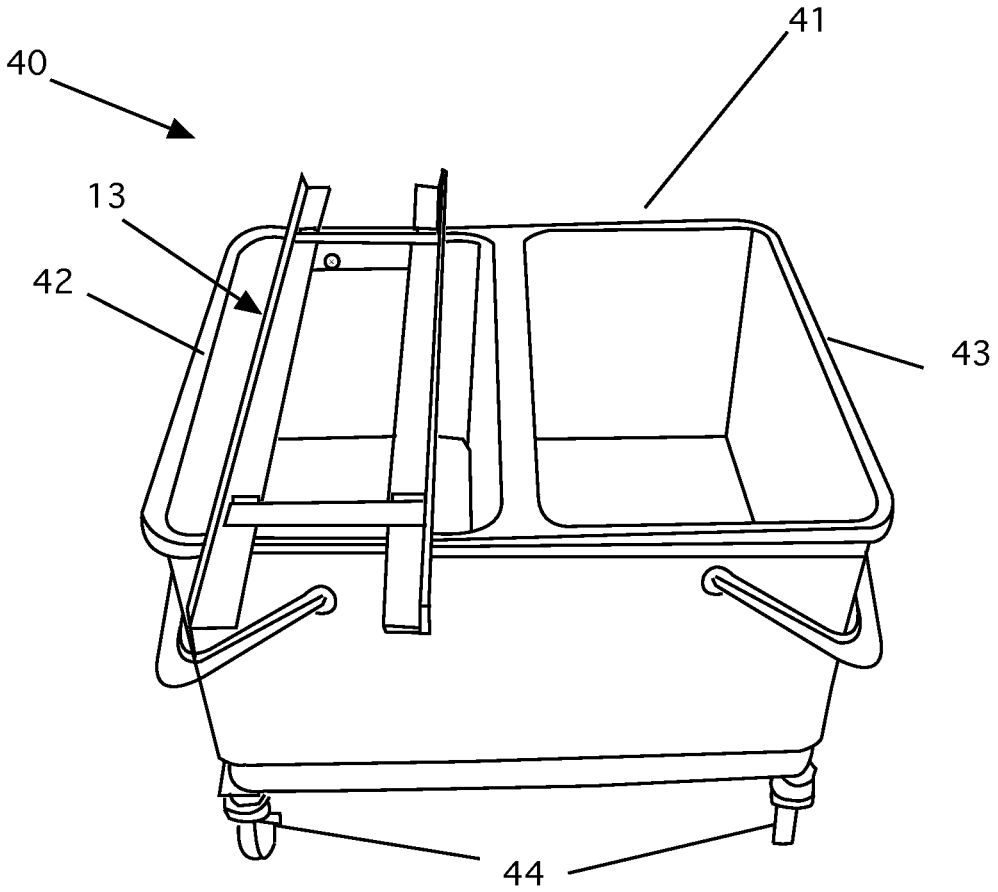
FIG. 10 is a side perspective view of the preferred embodiment of the invention with no water in the bucket.

Although the use of two buckets and the connector is a good design, the preferred embodiment used a single bucket with two compartments. FIG. 10 is a side perspective view of the preferred embodiment of the invention with no water in the bucket. Here, the invention 40 has one bucket 41 that has two compartments 42 and 43. The compartment 42 is used to hold the dirty water and has the slide press 13 installed. The compartment 43 is used to hold the clean water. This design reduces cost, as only four casters 44 are needed.

Figure 11:
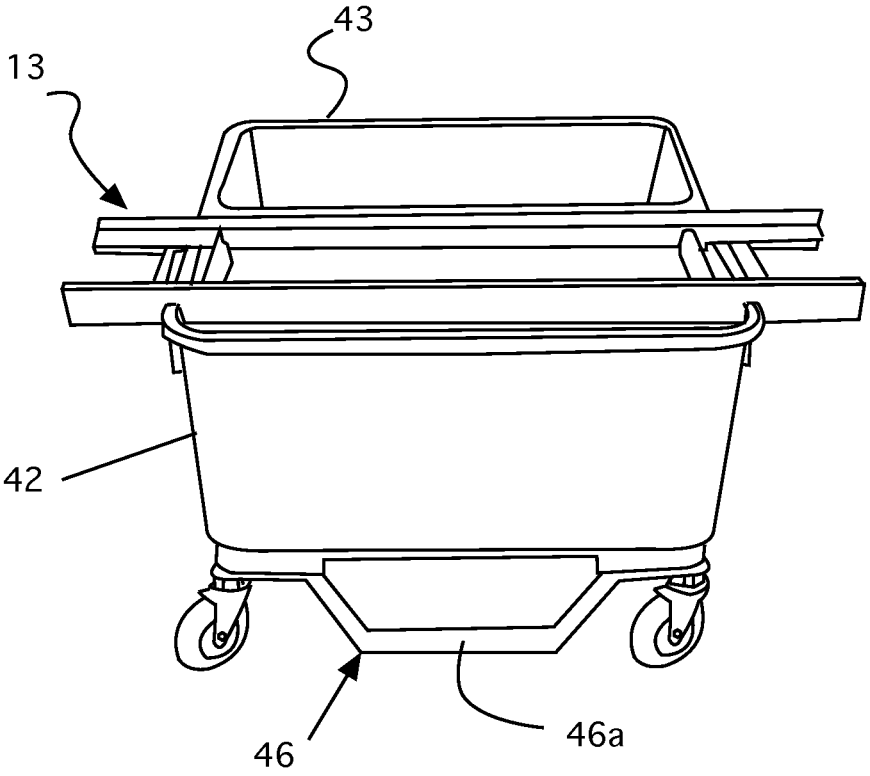
FIG. 11 is a front perspective view of the preferred embodiment of the invention.

FIG. 11 is a front perspective view of the preferred embodiment of the invention. As before, this design also uses a footpad bracket 46 with footpad 46*a*.

Figure 12:
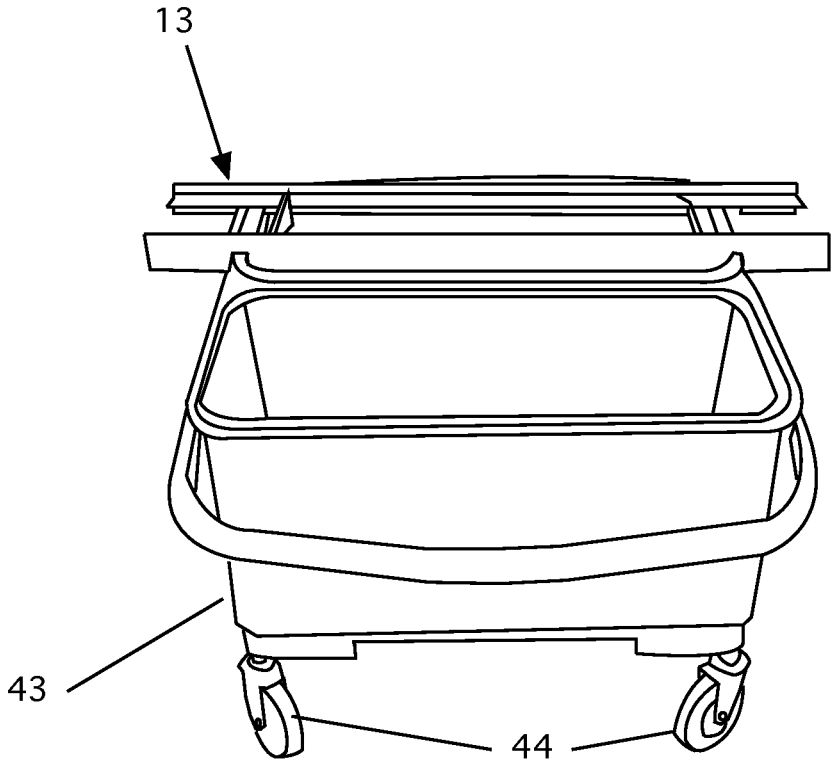
FIG. 12 is a rear perspective view of the preferred embodiment of the invention.

FIG. 12 is a rear perspective view of the preferred embodiment of the invention. Here, the clean-water side is shown.

Figure 13:
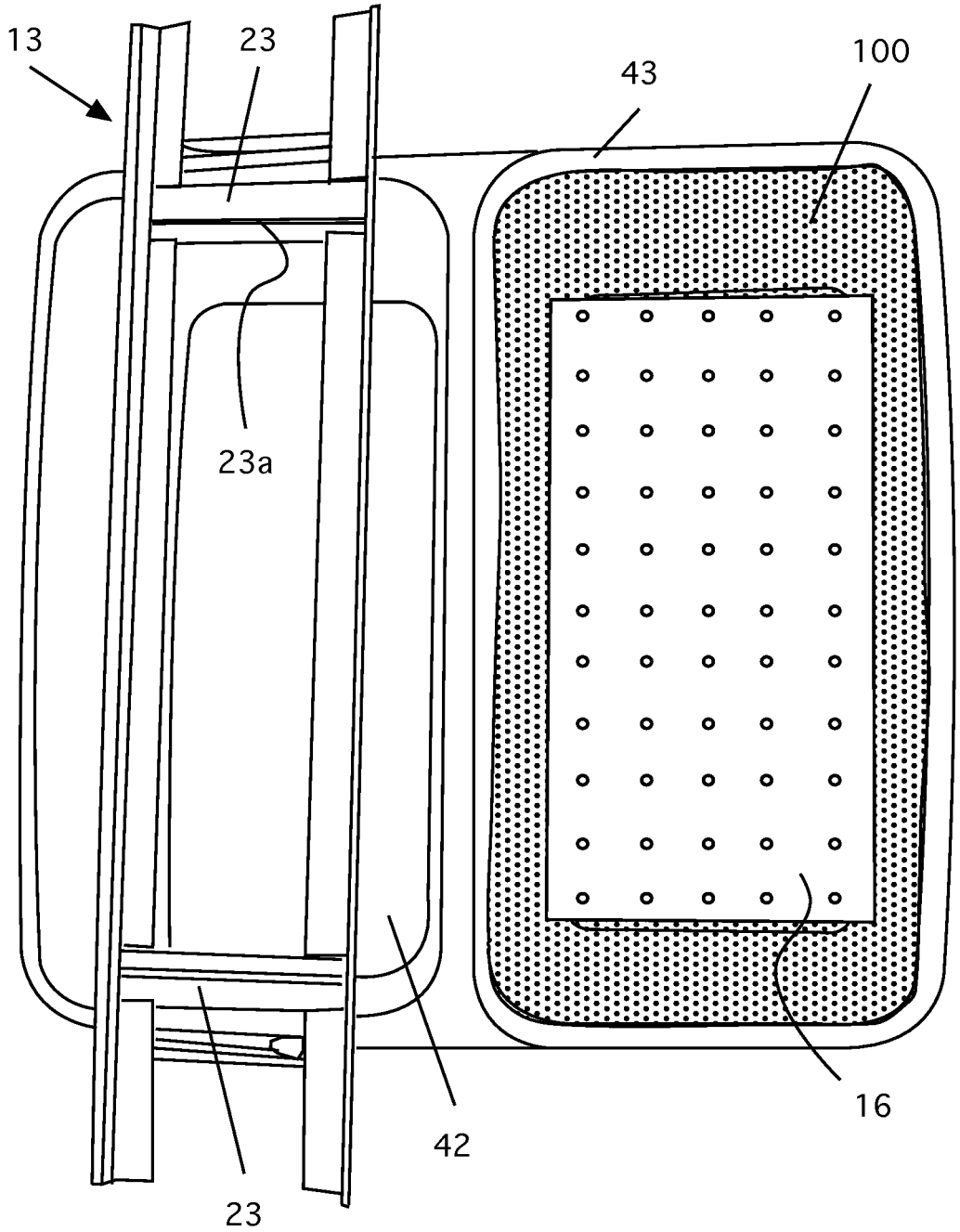
FIG. 13 is a top view of the preferred embodiment of the invention showing water in the clean side of the bucket.

FIG. 13 is a top view of the preferred embodiment of the invention showing water in the clean side of the bucket. The difference in this design being that the two compartments are part of one bucket. All other aspects of the invention remain the same.

Figure 14:
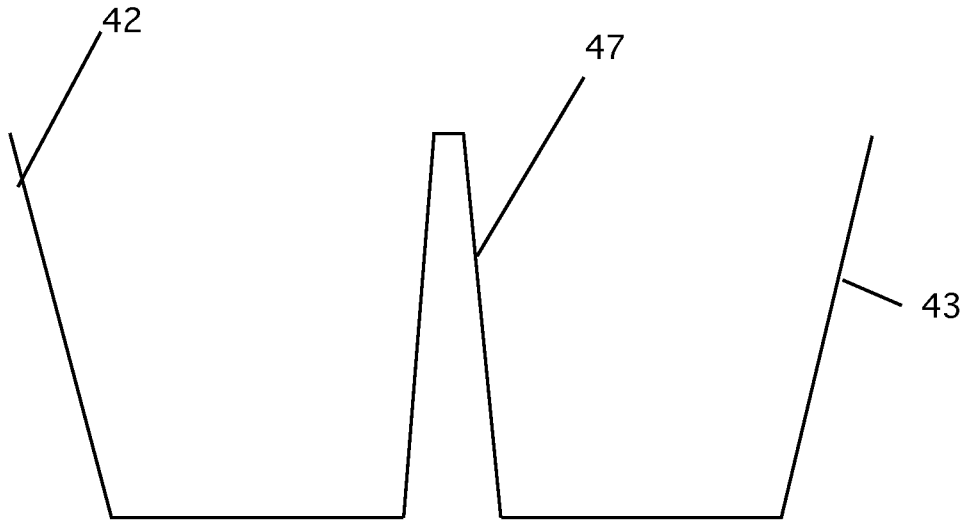
FIG. 14 is a cross-section of the single bucket showing the design of the partition.

FIG. 14 is a cross-section of the single bucket showing the design of the partition. Note that the joint partition wall 47 is show with a taper, being narrow at the top and wider at the bottom. This allows the buckets to be nested for shipping.

To use the either embodiment of the device, the user stands on the footpad 15*a* or 46*a* and holds the mop handle 32. First, the user dips the mop into the clean water bucket to pick up some clean water, which aids the pressing process. Next, the mop 30 is placed in the slide press 13. The user then pushes the mop through the slide press from one side to the other.

Once clean, the user can rewet the mop with clean water from the clean water bucket. However, it is preferred that the mop is used damp and not wet, so minimal water is needed for best operation. In this way, the mopping operation is kept simple and efficient in that the user has an easy way to clean the mop and always has a ready source of clean water to continue the mopping operation.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A cleaning bucket system for flat mops comprising:

a) a cleaning bucket having a first compartment and a second compartment, said first and second compartments being separated by a common wall; said first and second compartments each having a top wall perimeter and side edges;

b) a foot pad, installed on the cleaning bucket;

c) a slide press having two ends, said slide press positioned above said first compartment such that said two ends of said slide press overhang the side edges of said first compartment and extend outwardly in a horizontal plane; and d) at least one extractor positioned above said slide press, said at least one extractor having a flexible blade, such that when a flat mop is pushed across said slide press, dirty water contained in said flat mop is discharged into the first compartment.

2. The cleaning bucket system of claim 1 wherein the second compartment holds clean water.

3. The cleaning bucket system of claim 1 wherein the slide press has an open center portion.

4. A cleaning bucket system for flat mops comprising:

a) a first cleaning bucket having a top wall perimeter and side edges;

b) a second cleaning bucket having a top wall perimeter and side edges;

c) a connector bar having a center channel, said connector bar being positioned between one side edge of each of said first and said second cleaning buckets so that the first and second cleaning buckets are joined together;

d) a foot pad, installed on the first cleaning bucket;

e) a slide press having two ends, and said slide press positioned above said first cleaning bucket such that said two ends of said slide press overhang the side edges of said first cleaning bucket and extend outwardly in a horizontal plane; and f) at least one extractor positioned above said slide press, said at least one extractor having a flexible blade, such that when a flat mop is pushed across said slide press, dirty water contained in said flat mop is discharged into the first cleaning bucket.

5. The cleaning bucket system of claim 4 wherein the second cleaning bucket holds clean water.

6. The cleaning bucket system of claim 4 wherein the slide press has an open center portion.

* * * * *